US006645300B2

(12) United States Patent
Rehman et al.

(10) Patent No.: US 6,645,300 B2
(45) **Date of Patent: *Nov. 11, 2003**

(54) UNIPOLARITY POWDER COATING SYSTEMS INCLUDING IMPROVED TRIBOCHARGING AND CORONA GUNS

(75) Inventors: William R. Rehman, Vermillion, OH (US); Harry J. Lader, Lakewood, OH (US); James W. Messerly, Stow, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/085,505

(22) Filed: Feb. 28, 2002

(65) Prior Publication Data

US 2002/0117110 A1 Aug. 29, 2002

Related U.S. Application Data

(62) Division of application No. 09/724,363, filed on Nov. 28, 2000.

(60) Provisional application No. 60/217,261, filed on Jul. 11, 2000.

(51) Int. Cl.[7] ..... B05B 5/025; B05B 5/047; B05B 5/04

(52) U.S. Cl. ..... 118/629; 118/627; 118/621

(58) Field of Search ..... 118/629, 621, 118/620, 627; 427/458, 561, 562, 444; 239/690, 690.1, 692, 704, 705, 706, 707, 3

(56) References Cited

U.S. PATENT DOCUMENTS

| | | | | |
|---|---|---|---|---|
| 3,870,375 A | | 3/1975 | Duncan et al. | |
| 3,896,994 A | * | 7/1975 | Walberg | 239/3 |
| 3,903,321 A | | 9/1975 | Schaad | |
| 4,071,192 A | | 1/1978 | Myers | |
| 4,090,666 A | | 5/1978 | Peck | |
| 4,225,090 A | | 9/1980 | Kako et al. | |
| 4,233,335 A | | 11/1980 | Etlin | |
| 4,345,192 A | | 8/1982 | Kohzai et al. | |
| 4,359,192 A | | 11/1982 | Takahashi et al. | |
| 4,399,945 A | | 8/1983 | Ruud | |

(List continued on next page.)

FOREIGN PATENT DOCUMENTS

| | | |
|---|---|---|
| DE | 1577757 | 1/1971 |
| EP | 0592137 A1 | 9/1993 |
| EP | 0627265 A1 | 6/1994 |
| WO | WO 95/24272 | 9/1995 |
| WO | WO 99/01227 | 1/1999 |
| WO | WO 99/61166 | 12/1999 |

OTHER PUBLICATIONS

Scobbo, J.J. Jr., "Conductive Polyphenylene Ether/Polyamide Blends for Electrostatic Painting Applications", Conductive Polymers and Plastics, 1999, pp. 181–187.*

Powder Coating: The Complete Finisher's Handbook, The Powder Coating Institute, 2nd Printing, 1997, pp. 1–7.*

Interstate Plastics Product Specification, Delrin AF, 1999.*

Handbook of Plastic Compounds, Elastomers, and Resins.

*Primary Examiner*—Richard Crispino
*Assistant Examiner*—George R. Koch, III
(74) *Attorney, Agent, or Firm*—Calfee, Halter & Griswold LLP

(57) ABSTRACT

A plurality of unconventional negative tribo-charging materials are described for use as the powder contact surfaces in tribocharging and corona powder spray guns, gun components, and powder delivery system components. The invention also provides a short barrel tribo-charging powder spray gun having an interchangeable powder contact insert and nozzle, with turbulence inducing air jets. The invention further provides novel tribocharging and corona gun designs. Improved powder coating systems are made possible wherein, for example, negative tribo guns can be utilized with negative corona guns to coat different parts of the same workpiece in a powder coating system.

14 Claims, 7 Drawing Sheets

U.S. PATENT DOCUMENTS 4,597,534 A 7/1986 Ruud
4,659,011 A 4/1987 Moos
4,715,535 A 12/1987 Mulder
4,798,340 A 1/1989 Vohringer et al.
4,830,279 A 5/1989 Crum et al.
4,886,215 A 12/1989 Ruud
4,979,680 A 12/1990 Bauch et al.
5,011,085 A 4/1991 Loof
5,044,564 A 9/1991 Sickles
5,056,720 A 10/1991 Crum et al.
5,086,972 A 2/1992 Chang et al.
5,181,661 A 1/1993 Wollard
5,344,082 A 9/1994 Haller et al.
5,395,046 A 3/1995 Knobbe et al.
5,400,976 A 3/1995 Kaijyu et al.
5,402,940 A 4/1995 Haller et al.
5,487,624 A 1/1996 Toyota et al.
5,620,138 A 4/1997 Crum
5,622,313 A 4/1997 Lader et al.
5,683,844 A * 11/1997 Mammino ..... 430/111.2
5,739,429 A 4/1998 Schmitkons et al.
5,850,976 A 12/1998 Robidoux
5,885,351 A 3/1999 Long et al.
6,032,871 A 3/2000 Borner et al.
6,045,053 A 4/2000 Ruud
6,254,684 B1 * 7/2001 Borner et al. ..... 118/629

* cited by examiner

UNIPOLARITY POWDER COATING SYSTEMS INCLUDING IMPROVED TRIBOCHARGING AND CORONA GUNS

RELATED APPLICATIONS

This application is a divisional application of Ser. No. 09/724,363, filed Nov. 28, 2000 which is fully incorporated by reference herein, which claimed the benefit of U.S. Provisional patent application No. 60/217,261 filed on Jul. 11, 2000, for A UNIPOLARITY POWDER COATING SYSTEM INCLUDING AN IMPROVED TRIBOCHARGING GUN, UNIPOLARITY GUN, AND METHOD FOR MAKING SAME, the entire disclosure of which is incorporated by reference herein.

FIELD OF THE INVENTION

This invention relates to powder coating systems which use corona and tribocharging powder spray guns to apply an electrostatic charge to powder for deposition on a substrate.

BACKGROUND OF THE INVENTION

There are two basic types of powder spray guns which are commonly used in the electrostatic powder spray coating of articles. The most common type of spray gun is the corona type, which has a high voltage charging electrode which produces a corona to charge the powder. Typically, corona guns are designed to charge the powder negatively. One major disadvantage of corona guns is that they do not coat the interior corners of parts well due to the strong electrostatic field or Faraday caging effect produced by the corona electrode. A second disadvantage to corona guns is that back ionization may occur due to the formation of free ions which results in pinholing or an orange peel surface of the part to be coated. Another disadvantage to these type of guns is that the system components such as the nozzle, and diffuser as well as the powder deliver system components such as the pump, hopper and other parts in contact with the powder delivery system are typically made of materials such as polyethylene or polytetrafluoroethylene (PTFE). While these materials have the advantage of low impact fusion, they have the disadvantage of positively charging the powder, which can impair the negative corona charging process because the final or maximum charge on the powder is diminished. Further, more voltage is often required in order to counteract the positive polarity charging of the system. In addition, this positive polarity tribocharging may cause breakdown of the powder conveying components such as the hose, which connects the pump to the spray gun.

A second type of gun which is also commonly used is a tribocharging gun in which the powder is charged by frictional contact with the interior surfaces of the gun. One advantage to triboelectric guns is that the powder can easily penetrate corners of parts to be coated because the gun does not produce a strong electric field like a corona gun does.

SUMMARY OF THE PRESENT INVENTION

The invention provides novel electrostatic powder coating guns and system components in which powder is precharged to the same polarity as a charge applied by the powder spray gun in order to increase and enhance the applied charge and the transfer efficiency. Also novel powder coating methods are described.

In accordance with one aspect of the invention, an apparatus for spraying powder coating material is described. The apparatus has a powder flow path, wherein the powder flow path has a charging surface for triboelectrically charging powder coating material which comes in contact with the charging surface, and the charging surface comprises a negative tribocharging material selected from polyamide resin blends, fiber reinforced polyamides, aminoplastic resins and acetal polymers.

In accordance with another aspect of the invention, an apparatus for spraying powder coating material has a powder flow path, wherein the powder flow path has a charging surface for triboelectrically charging powder coating material which comes in contact with the charging surface, and wherein one or more air passages are formed through the charging surface, the air passages being in a fluid communication with a source of compressed air.

In accordance with another aspect of the invention, an apparatus for spraying powder coating material is described. The apparatus has a powder flow path through which the powder coating material flows, wherein the powder flow path has a first charging surface for triboelectrically charging powder coating material which comes in contact with the first charging surface, the first charging surface comprising a tribocharging material having a first charging polarity, the apparatus further comprising a component through which powder coating material also flows, the component having a second charging surface which also comprises a tribocharging material having the first charging polarity.

In accordance with another aspect of the invention, a system for applying powder coating materials to articles is described. The system includes a powder feed apparatus for supplying powder coating material and an apparatus for spraying powder coating material received from the feed apparatus. The spraying apparatus has an electrode for charging the powder coating material a first charging polarity. The feed apparatus includes a component having a charging surface for triboelectrically charging powder coating material which comes in contact with the charging surface, the charging surface comprising a tribocharging material having the first charging polarity.

In accordance with another aspect of the invention, a system for applying powder coating materials to articles is described. The system includes at least one corona charging spraying apparatus and at least one tribocharging spraying apparatus. The corona charging spraying apparatus has an electrode for charging the powder coating material a first charging polarity. The tribocharging spraying apparatus has a powder flow path, wherein the powder flow path has a charging surface for triboelectrically charging powder coating material which comes in contact with the charging surface, the powder coating material being charged to the first polarity by the charging surface of the tribocharging spraying apparatus.

In accordance with another aspect of the invention, a tribocharging powder spraying apparatus is described. The apparatus includes a body having an internal bore, a wear tube located within the internal bore, and an open passageway provided between the internal bore and the wear tube, with at least one air jet passageway being provided through the wear tube. The air jet passageway provides fluid communication between the open passageway and the interior of the wear tube. The wear tube has a charging surface for triboelectrically charging powder coating material which comes in contact with the charging surface. The open passageway is in fluid communication with a source of compressed air, whereby compressed air flows from the open passageway through the air jet passageway into the interior of the wear tube to affect the flow of powder coating material through the wear tube.

In accordance with another aspect of the invention, a system for applying powder coating materials to articles is described. The system includes a powder feed apparatus for supplying powder coating material and an apparatus for spraying powder coating material received from the feed apparatus. The feed apparatus includes a component having a charging surface for triboelectrically charging powder coating material that comes in contact with the charging surface. The component charging surface is comprised of a negative tribocharging material selected from polyamide resin blends, fiber reinforced polyamides, aminoplastic resins and acetal polymers.

These and other aspects of the invention are herein described in detail with reference to the accompanying Figures.

DETAILED DESCRIPTION OF PREFERRED AND ALTERNATE EMBODIMENTS

Figure 1:
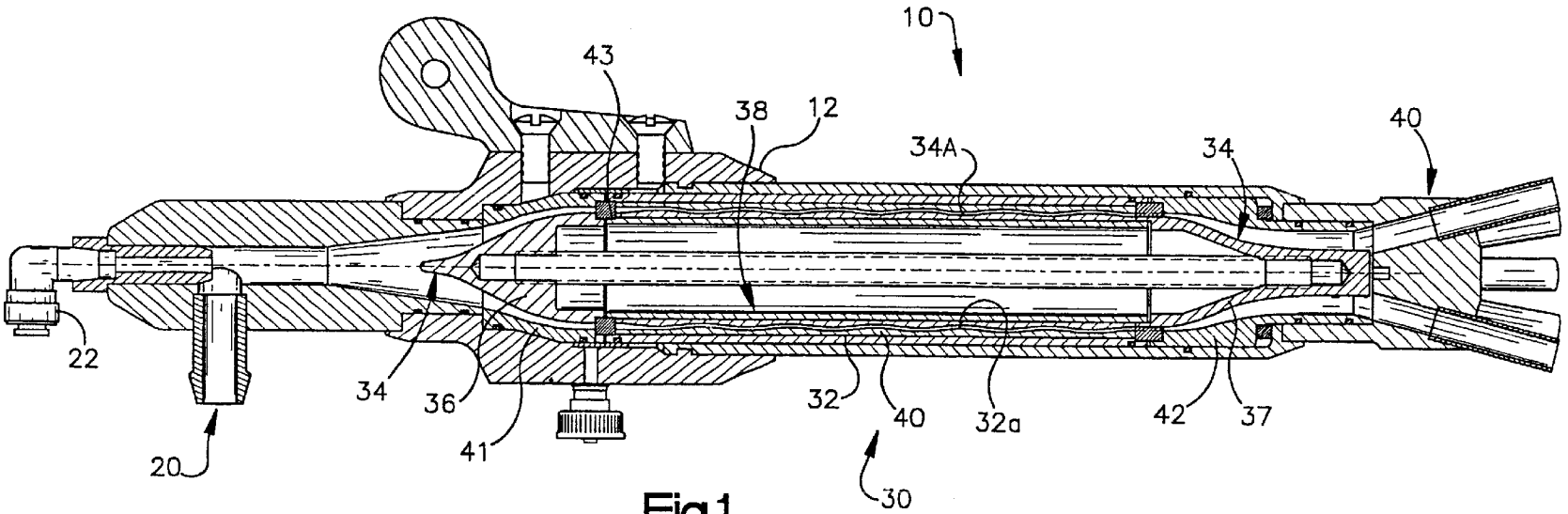
FIG. 1 is a cross-sectional view of a tribocharging gun which incorporates the novel unconventional materials of the invention.

The following Detailed Description of Preferred and Alternate Embodiments is divided into the following sections. Section I provides a detailed description of a novel tribocharging gun which charges a powder to a negative polarity by frictional contact with novel use of unconventional materials as described in more detail below. Section II provides a detailed description of a novel short barrel tribocharging gun which can charge powder to a positive or negative polarity depending upon the materials selected for frictional contact with the tribocharging surfaces of the gun. Sections III and IV concern a corona gun and powder supply system, respectively, with the corona gun and system including components which charge the powder to the same polarity as the corona gun by frictionally contacting the powder with tribocharging surfaces comprised of the desired positive or negative tribocharging material. Section V provides a detailed description of a powder coating system which includes corona and tribocharging guns which charge the powder to the same polarity so that the tribocharging gun can be used in conjunction with the corona gun to coat the same workpiece. Finally, Section VI provides a detailed description of an alternate tribocharging gun embodiment which utilizes airjets.

I. Negative Tribocharging Gun Constructed from Unconventional Materials.

A. Unconventional Negative Charging Tribomaterials

A part of this invention is the discovery of what will be referred to herein as "unconventional negative charging tribomaterials". These materials are useful as powder contact surfaces for negatively charging powder coating material by frictional contact with the powder contact surfaces of a powder spray gun. The term "negative charging tribomaterials" means materials which impart a negative charge to powders, such as powdered paints, upon frictional impact with the surface of the negative charging tribomaterials.

As described in more detail in this application, the unconventional negative charging tribomaterials could be used as the interior surfaces of tribocharging or corona powder spray guns, as well as spray gun components and powder delivery system components such as the diffuser, powder tube, feed hopper, and pump as described in more detail in Section IV. Although the unconventional negative charging tribomaterials are known generally, they have not been previously known to be useful in spray guns in order to tribocharge powder coating materials.

The non-conventional negative charging tribomaterials are selected from polyamide blends, fiber reinforced polyamide resins, the aminoplastic resins, acetal polymers or mixture thereof, and are described in more detail, below. These materials not only charge well negatively but they also do not experience impact fusion problems as significant as negative tribo charging materials which have been used in the past such as nylon.

1. The Polyamide Blend

The polyamide blend comprises a blend of a polyamide polymer and a second polymer selected from the group consisting of: polyethylene, polypropylene, halogenated hydrocarbon resin, and mixtures thereof. The polyamide polymer is preferably present in the polyamide blend from 50% to 96%, more preferably from 70% to 90%, by weight. The second polymer is preferably present in the polyamide blend from about 4% to about 50%, more preferably from about 10% to about 30%, most preferably from about 15% to about 25% by weight.

The halogenated hydrocarbon resin is preferably a fluorinated hydrocarbon resin, such as for example, polytetrafluoroethylene, (also known as PTFE); a copolymer of tetrafluoroethylene and hexafluoropropylene (also known as FEP); and a copolymer of tetrafluoroethylene and perfluorinated vinyl ether (also known as PFA). Suitable fluorinated resins are commercially available under the tradename TEFLON® from DuPont.

The polyamide polymer in the polyamide blend is preferably a nylon. Preferred grades of nylon are nylon 6/6, nylon 6/12, nylon 4/6 and nylon 11. A suitable polyamide blend is a 20% polytetrafluoethylene and 80% nylon 6/6 commercially available under the trade name Lubricon RL 4040 from LNP Engineering Plastics, Division of ICI Advanced Materials, Exton, Pa. A suitable blend is about a 5% polytetrafluoethylene and about a 95% nylon 6/6 commercially available under the trade name Lubricon RL 4010 from LNP Engineering Plastics, Division of ICI Advanced Materials, Exton, Pa.

Example 1

Individual discs of a 20% polytetrafluoethylene and 80% nylon 6/6, polyamide/halogenated hydrocarbon resin blend were prepared. For comparison, coupons of conventional material, that is, nylon and Teflon were also prepared.

The relative transfer efficiency was determined by spraying powder paint from a flat spray nozzle with a 0.450 inch by 0.065 inch slot at an air flow rate of 4 cubic feet per minute onto a disc at a 45° angle. The powder impacted the surface of the disc of the tribocharging material and was deflected from the disc onto a grounded metal target. The powder exiting the nozzle had a measured initial charge of zero. Thus, all of the powder charging was due to impacting the tribomaterial. The amount of powder adhered to the target as compared to the total powder sprayed is defined as the relative transfer efficiency. Typically, 50 grams of polyester epoxy powder from Ferro Corporation was the powder used for the tests. Since this relative transfer efficiency test is done by a single impact from a coupon, the values tend to be lower than for numerous contacts using a tribocharging gun.

The powder used in the evaluation was a polyester epoxy powder, designated 153W-121, from Ferro Corporation. The results are shown below in Table I.

Example 2

Individual discs of a 5% PTFE and 95% nylon 6/6, polyamide blend were prepared and the transfer efficiency was evaluated as in Example 1. The results are shown below in Table I.

The advantage of using the polyamide blends in powder spray guns is that they increase the powder charging due to increased discharging of the tribocharged gun surfaces. The increased surface discharging is due to the incompatible polymers which provide for a leakage path that is not present in the homogeneous polymer. Another advantage of using these polyamide blends is that reduced moisture absorption of nylons occur when they are filled with PTFE or polyethylene.

2. The Fiber Reinforced Polyamide Resin

The fiber reinforced polyamide resin comprise a polyamide polymer filled with polyaramide fibers. Preferably there is from about 50% to about 99%, more preferably from about 85% to about 95% of the polyamide polymer. Preferably there is from about 1% to about 50%, and more preferably from about 5% to about 15% of the polyaramide fiber in the polyamide polymer.

The polyamide polymer in the fiber reinforced polyamide resin is preferably commercially available polyamide polymers. Suitable polyamides are for example, nylons.

The polyaramide fibers are long chain synthetic aromatic polyamides in which at least 85% of the amide linkages are attached directly to two aromatic rings. A suitable polyaramide fiber is a poly(p-phenylene terephthalamide) commercially available under the trade name KEVLAR®, from DuPont. The polyaramide fiber, poly(m-phenylene terephthalamide), commercially available under the trade name Nomex, from DuPont, is less preferred. Examples of other polyaramide fibers are the polymer comprising polymerized units of p-aminobenzhydrazide and terephthaloyl chloride; a suitable such polymer is commercially available under the trade name PABH-T X-500 from Monsanto.

A suitable fiber reinforced polyamide resin is 10% KEVLAR® in 90% nylon 6,6 available under the trade name Lubricon RA from LNP Engineering Plastics, Division of ICI Advanced Materials, Exton, Pa.

Example 3

Individual discs of the fiber reinforced polyamide resin were prepared. For comparison, coupons of conventional, non fiber containing nylon and Teflon were also prepared. The relative transfer efficiency was determined as in Example 1. The results are shown below in Table I.

TABLE I

| EXAMPLE | MATERIAL | DISK THICKNESS (IN) | POLARITY | RELATIVE TRANSFER EFFICIENCY % |
|---|---|---|---|---|
| Comparative | Nylon 6,6 | 0.155 | – | 16.5 |
| 1 | 5% PTFE in Nylon 6,6 | 0.250 | – | 21.3 |
| 2 | 20% PTFE in Nylon 6,6 | 0.250 | – | 24.7 |
| 3 | 10% KEVLAR ® in Nylon 6,6 | 0.123 | – | 39.2 |
| Comparative | 100% KEVLAR ® tow fibers | — | + | 54.3 |
| 4 | Nylon R $MoS_2$ filled | 0.118 | – | 22.4 |

Surprisingly, despite the fact that the KEVLAR® tow fiber charges powder positively in the comparative example, the addition of such fiber to the nylon which charges negatively, increased the relative transfer efficiency.

3. The Aminoplastic Resins

The aminoplastic resins are comprised of polymerized units of an amine monomer and an aldehyde monomer. Preferred aminio plastic resins are aniline formaldehyde resins, urea formaldehyde resins and melamine formaldehyde resins. Optionally, the aminoplastic resins further comprise cellulose such as alpha-cellulose and pigments.

Suitable molding grade melamine formaldehyde resins filled with alpha cellulose, are commercially available under the trade name Perstorp 752026 white melamine or Perstorp 775270 red melamine available from Perstorp Compounds, Inc. in Florence, Mass. Another suitable melamine resin is a melamine phenol-formaldehyde copolymer, commercially available under the trade name Plenco 00732, from Plenco Plastics Engineering Company in Sheboygan, Wis.

Another suitable melamine resin is a melamine formaldehyde polymer, Perstop 752-046, available from Perstorp Compounds, Inc. in Florence, Mass.

Example 4

Individual discs of the white melamine formaldehyde resin, Perstorp 752026, filled with alpha cellulose were obtained. For comparison, discs of conventional nylon 6/6 were also prepared. Relative transfer efficiency was determined as in Example 1. The results are shown below in Table II.

Example 5

Individual discs of the red peppercorn melamine formaldehyde resin, Perstorp 775270, filled with alpha cellulose were obtained. For comparison, discs of conventional nylon were also prepared. The relative transfer efficiency was determined as in Example 1. The results are shown below in Table II.

Example 6

Individual discs of the melamine phenol-formaldehyde resin, Plenco 00732 were obtained. For comparison, discs of conventional nylon were also prepared. The relative transfer efficiency was determined as in Example 1. The results are shown below in Table II.

Example 7

Individual discs of the white melamine formaldehyde resin Perstorp 752-046, were obtained. For comparison, discs of conventional nylon were also prepared. The relative transfer efficiency was determined as in Example 1. The results are shown below in Table II.

TABLE II

RELATIVE TRANSFER EFFICIENCY OF FERRO 153W-121 ON CONTACT WITH AMINO RESIN COUPONS

| EXAMPLE | MATERIAL | POLARITY | RELATIVE TE (%) |
|---|---|---|---|
| Comparative | Nylon 6/6 | Negative | 16.5 |
| 4 | Perstorp 752026 white Melamine | Negative | 37.7 |
| 5 | Perstorp 775270 red Peppercorn melamine | Negative | 37.0 |
| 6 | Plenco 00732 melamine/ phenol formaldehyde | Negative | 28.7 |
| 7 | Perstorp 752-046 Melamine-formaldehyde | Negative | 44.9 |

Powder flow rate = 1.5 g/s

Examples 8–10

Figure 2:
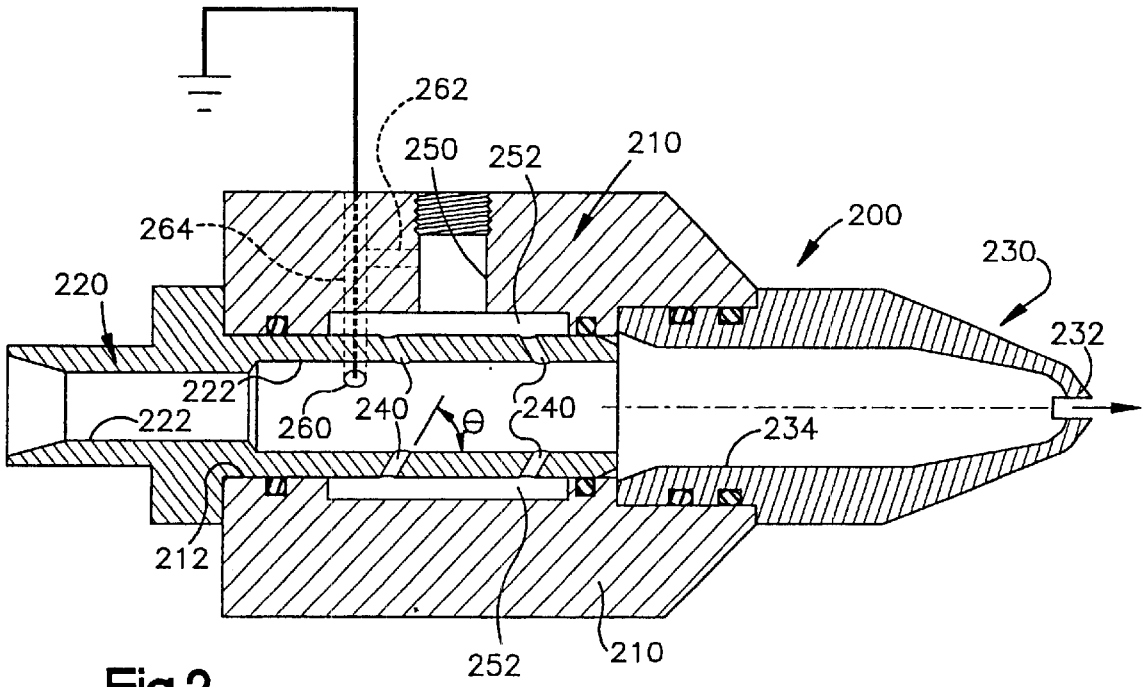
FIG. 2 is a cross-sectional view of a novel short barrel tribocharging gun of the present invention.

A short barrel tribo gun as described herein in Section II and shown in FIG. 2, was fabricated, in which the interior surfaces of the gun, specifically the interior surface of the powder conduit insert and flat spray nozzle, were made of red peppercorn, melamine formaldehyde, designated Perstorp 775270 from Perstorp Compounds Inc., Florence, Mass. The gun used in the test had two pairs of air jets and two electrodes. The air jets were offset from the centerline which is perpendicular to the longitudinal axis by one jet diameter and the second set of air jets was rotated about the longitudinal axis by 5 degrees relative from the first set of air jets. The angle of the air jets was 90 degrees.

The relative transfer efficiency was determined by spraying a set amount of powder at a target, moving perpendicular to the spray gun at the rate of 10 feet per minute. The powder in the spray gun was an epoxy polyester powder, designated 153W-121 from Ferro Corporation. The results are presented below.

TABLE III

| EXAMPLE NO. | MELAMINE FORMALD. GRADE | POLARITY | RELATIVE TRANSFER EFFICIENCY % |
|---|---|---|---|
| Comparative | Nylon 6/6 | Negative | 79.3 |
| Ex. 8 | Melamine G-9 from Atlas Fibre Co. of Skokie, Illinois | Negative | 80.6 |
| Ex. 9 | Red peppercorn melamine Perstorp 775270 | Negative | 74.3 |
| Ex. 10 | White melamine 700 Series Molding Compound from Perstorp | Negative | 74.7 |

4. Acetal Resins

The acetal resin is a polyoxymethylene engineering thermoplastic polymer. The acetal resin is a homopolymer or a copolymer. The acetal resin is optionally combined with polytetrafluorethylene, polytetrafluoroethylene fibers, and polyethylene, or other polymers or additives. Suitable acetal homopolymers are commercially available under the trademark Delrin® from E. I. DuPont de Nemours & Co., in Wilmington, Del. A suitable example is an acetal homopolymer resin comprising 20% Teflon PTFE fibers, and is commercially available under the trade name Delrin AF. One advantage of this material is that electrical shocks from stored capacitance to operators handling this gun are less with this material than other materials tested.

A suitable modified copolymer resin is an acetal copolymer modified with an ultra high molecular weight polyethylene (UHMWPE) which is commercially available under the trade name Ultraform® N2380X available from BASF Corp., Parsippany, N.J. Another suitable acetal copolymer is commercially available under the trade name Celcon® from the Hoechst Celanese Corp. in Chatam, N. J.

Example 11

A short barrel tribocharging gun as described below in Section II and shown in FIG. 2, was fabricated, in which the interior surfaces of the gun, specifically the interior surface of the insert were made from the acetal polymer Delrin 150 from DuPont.

The powder in the spray gun was an epoxy polyester powder, designated 153W-121 from Ferro Corporation or a polyester/urethane powder, designated 153W-281 from Ferro Corporation. The transfer efficiency was determined as in the Examples 8–10. The results are presented below.

Transfer efficiency results are about 62% for both powders as shown in Table IV. below at a flow rate of 2.5 g/s.

TABLE IV

| AVERAGE TRANSFER EFFICIENCY OF DELRIN SHORT TRIBO GUN | |
|---|---|
| SAMPLE | AVERAGE TE (%) |
| 153W-121 | 61.9 |
| 155W-281 | 62.3 |

One advantage to these acetal resins is that they are capable of being injection molded, thus making it possible to fabricate a low cost powder spray gun. The Delrin acetal resin relative transfer efficiency results were surprising and unexpected because the Delrin resin does not contain nitrogen atoms, which are typically found in negatively charging materials such as nylon and melamines. It was also discovered that the presence of PTFE fibers in the Delrin acetal resin, such as with the Delrin AF acetal resin, resulted in an increase in transfer efficiency over the Delrin acetal resin.

B. Negative Tribocharging Gun with Unconventional Materials

Referring now to FIG. 1, there is shown a tribocharging powder spray gun 10 for use with the method and apparatus of the present inventions. The gun 10 includes a gun body 12 having a central opening extending therethrough. The gun 10 may be supported by a suitable gun mount assembly which is known by those skilled in the art. The gun 10 comprises a powder feed portion 20, a tribocharging portion 30 and a sprayhead portion 40 at the outlet end of the gun.

The tribocharging portion 30 of the gun comprises an inner core 34 positioned within an outer cylinder 32 in which the surfaces 34*a,* 32*a* cooperate to provide an annular charging path for the powder flowing through the charging path of the gun. As shown in FIG. 1, the surfaces 34*a,* 32*a* may optionally comprise a wavy or undulating surface so that the annular gap provides a tortuous path for the powder, thereby enhancing powder contact with the surfaces 34*a,*32*a* so that charge is imparted to the powder.

In the preferred embodiment of the invention, some or all of the powder contact surfaces of the gun are comprised of a material selected from the group consisting of: a polyamide blend, a fiber reinforced polyamide resin, an acetal polymer, an acetal polymer homopolyrner, a copolymer, preferably filled with PTFE fibers (hereinafter collectively referred to as acetyl polymer), an aminoplastic resin or mixtures thereof. These are the unconventional negative charging tribo materials of this invention which have been found to charge well. Thus the powder contact surface may be coated with the above mentioned material or the respective component having the powder contact surface may be constructed in whole or in part from the above mentioned materials. Thus as shown in FIG. 1, the powder contact surfaces of the outer cylinder 32, the inner core 34 and the nozzle 40 may be comprised of a material selected from the group consisting of a polyamide blend, fiber reinforced polyamide resin, acetal polymer, aminoplastic resin or mixtures thereof. Additionally, the powder contact surfaces of the inner wear sleeve 38, the outer wear sleeve 40, the inlet wear sleeve 41, the inlet distributor 36, the outlet distributor 37, and the outlet wear sleeve 42 may be coated with or made entirely of a material selected from the group consisting of a polyamide blend, fiber reinforced polyamide resin, acetal polymer, aminoplastic resin or mixtures thereof. Other powder contact surfaces not specifically referenced herein may also comprise the above referenced materials.

A grounded electrode 43, discharge ring or other means know to those skilled in the art (not shown) may be utilized to discharge the powder contact surfaces of the inner core and outer cylinder from the build up of charge. The grounded electrode or discharge ring may be placed in any position known to those skilled in the art.

As shown in FIG. 1, powder and the conveying air is fed to the powder feed portion 20. Powder enters the charging portion of the gun from the feed portion 20 and is channeled into the annular charging path located between the inner core 34 and the outer cylinder 32. As the air entrained powder repeatedly contacts the powder contact surfaces 32*a,* 34*a* of the outer cylinder 32 and inner core 34, the powder is tribocharged to a negative polarity. Finally, the tribocharged powder is discharged into the sprayhead portion 40 of the gun. In that unconventional negative charging tribo materials are used, the powder will be negatively charged, but the gun will not experience unacceptable impact fusion of the powder on the charging surface.

II. Short Barrel Tribocharging Powder Spray Gun Constructed from Either Positive or Novel Negative Tribocharging Materials.

As shown in FIG. 2, a first embodiment of the short barrel tribocharging gun 200 of this invention provides a novel powder spray gun of relatively simple construction and small size which charges powder by the tribocharging process. The invention has the advantage of a removable insert 220 which can be easily changed for fast color change of the powder. One important advantage to the short barrel tribogun is that it does not have the disadvantages of strong electric fields or back ionization issues which are present with corona guns. The gun as described in more detail below can positively or negatively charge a powder. The triboelectric powder charging gun, indicated generally at 200, has an overall length in a range of approximately one to ten inches from the powder inlet to the nozzle tip, and more preferably in the range of one to six inches, which is substantially less than the overall length of tribocharging guns of the prior art, which typically run from 14–36 inches in length.

The main components of the gun are a body 210, a powder conduit insert 220 which fits within the body 210, and a nozzle 230 which also fits within or is otherwise attached to the body 210. The insert 220 and nozzle 230 together form the barrel of the gun. The body 210 can be fabricated out of any structurally suitable material. The body 210 has an intake end 212 having an opening adapted to receive an insert 220, and an output end 214 adapted to receive or connect to the nozzle 230. For manual use, a handle or pistol grip (not shown) may be attached to or formed as an integral part of the body 210.

The powder conduit insert 220 is preferably a cylindrical tube having an interior powder passageway 222. The inner diameter of the powder passageway 222 may preferably be in the range of about 0.25 inches to about 1.5 inches, and most preferably is 0.5".

It is preferred that the insert 220 be removably or releasably connected to the body by conventional methods. For a negative polarity gun, it is preferred that the insert 220 be entirely made of, or have an interior surface 222 coated with, the materials selected from the polyamides, preferably nylon 6/6, a polyamide blend, fiber reinforced polyamide resin, acetal polymer, aminoplastic resin or mixtures thereof. For a positive charging gun, the insert 220 may be entirely made of, or have an interior surface 222 coated with a tribocharging material such as, but not limited to, fluoropolymers particularly polytetrafluoroethylene, or mixtures thereof. Thus depending upon the type of tribocharging material selected, a negative or positive charge is imparted to the powder particles upon contact with the interior powder contact surfaces of the insert 220.

The spray gun 200 may further comprise one or more air jets 240 which are provided within the interior passageway 222, 234 of the gun. The air jets 240 may be located within the insert 220 or the nozzle 230, and function to create turbulence resulting in the increase of frictional contact of the powder with the walls 222 of the insert 220 or the nozzle 230. Air or other fluid (hereinafter air) is supplied to the air jets 240 via air passage 250 formed in the body 210, which leads to a chamber 252 about the insert 220 or nozzle (not shown). One or more air jets 240 lead from chamber 252 to the powder passageway 222, 234 in insert 220 or nozzle 230 (not shown).

The air jets 240 may comprise any orifice shape such as round, rectangular, square or oval. Each air jet cross-sectional area may range from about 0.001 to about 0.02 square inches (which corresponds to a round hole size of about 0.01 to about 0.25 inches in diameter). More preferably, each air jet cross-sectional area may be in the range of about 0.0001 to about 0.0491 square inches (which corresponds to a round hole size diameter of about 0.06 to about 0.08 inches). Most preferably, the air jet cross-sectional area may be about 0.0038 square inches, which corresponds to a round hole size diameter of about 0.07 inches.

As shown in FIG. 2, the air jets 240 define an angle Θ with respect to the longitudinal axis or insert or nozzle side wall of the internal passageway 222 in the range of about 0 to about 90 degrees, and more preferably in the range of about 45 to about 90 degrees, and most preferably about 60 degrees.

Figure 3A:
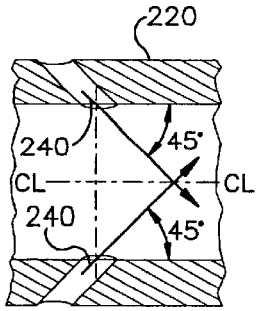
FIGS. 3A through 3D illustrate a portion of the insert of the gun of FIG. 2 in which the airjets are arranged in various opposed configurations.
Figure 3B:
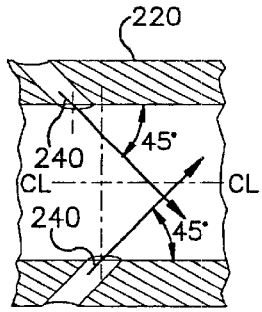
Figure 3C:
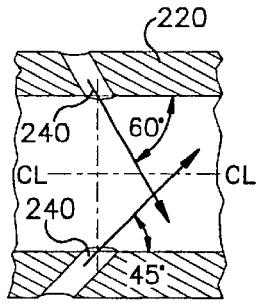
Figure 3D:
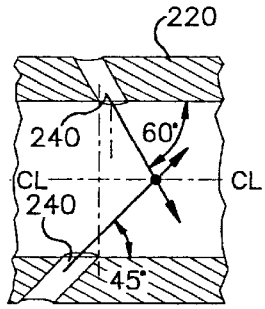

The air jets may be arranged in one or more groups of air jets with the same or differing diameters. A group may be two or more air jets which may be arranged in either an opposed or unopposed configuration. FIGS. 3A–3D illustrate alternate configurations of the arrangements of upper and lower air jets 240 of the insert 220. FIG. 3A illustrates an upper and lower air jet 240 in which the air flow from the jets intersect on the longitudinal axis (or centerline CL). Both the upper and lower air jets form an angle of 45 degrees with the insert sidewall 222. FIG. 3B is almost the same configuration as FIG. 3A except that the center of the upper air jet is longitudinally offset from center of the lower air jet, resulting in the air flow from the air jets intersecting at a point offset from the longitudinal axis. FIG. 3C illustrates that the air jets may have different air jet angles which results in the flow of the air jets intersecting at a point offset from the longitudinal axis. FIG. 3D illustrates that the upper and lower air jets may be longitudinally offset and have different angles yet result in the flow of the jets intersecting at the longitudinal axis.

Figure 4A:
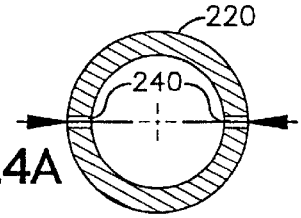
FIG. 4A illustrates a cross-sectional view of the insert of the short barrel tribocharging gun of FIG. 2, aft looking forward, in which the airjets are not vertically offset from each other.
Figure 4B:
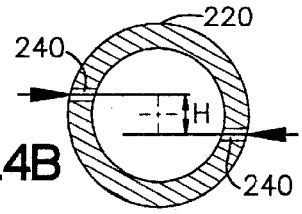
FIGS. 4B through 4E illustrate cross-sectional views of the insert of the short barrel tribocharging gun of FIG. 2, aft looking forward, in which the airjets are vertically offset from each other a perpendicular distance H.
Figure 4C:
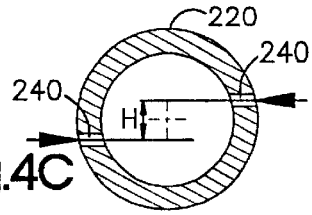
Figure 4D:
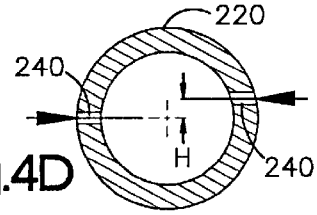
Figure 4E:
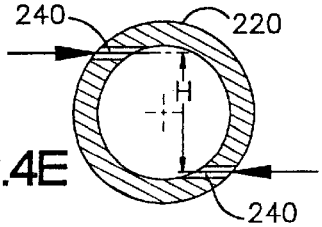

If two or more air jets are utilized, one air jet may be offset relative to another air jet a distance H perpendicular to the longitudinal axis as shown in FIGS. 4B–4E. Thus, in FIGS. 4B–4E the air jets are vertically offset from one another by varying the perpendicular (or vertical) distances H relative to the longitudinal axis. The distance H may vary from 0 (no offset) as shown in FIG. 4A, to one diameter of the insert as shown in FIG. 4E.

Figure 5A:
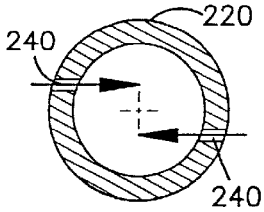
FIGS. 5A and 5B each illustrate a cross-sectional view of the insert of the short barrel tribocharging gun of FIG. 2, aft looking forward, in which a first set of airjets as shown in FIG. 5A are not rotationally offset from a second set of downstream airjets as shown in FIG. 5B.
Figure 5B:
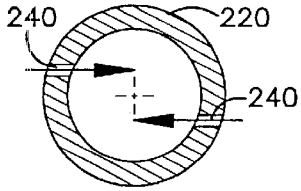
Figure 5C:
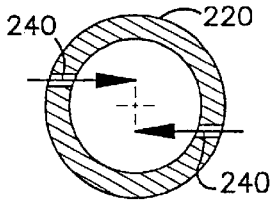
FIGS. 5E through 5F each illustrate a cross-sectional view of the insert of the short barrel tribocharging gun of FIG. 2, aft looking forward, in which a first set of airjets as shown in FIGS. 5C and 5E are rotationally offset from a second set of downstream airjets as shown in FIGS. 5D, and 5F, respectively.
FIGS. 5G and 5H each illustrate a cross-sectional view of the insert of the short barrel tribocharging gun of FIG. 2, aft looking forward, in which a first set of airjets as shown in FIGS. 5G are not rotationally offset from a single downstream airjet as shown in FIG. 5H.
Figure 5D:
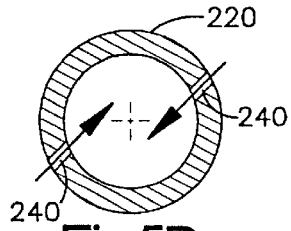
Figure 5E:
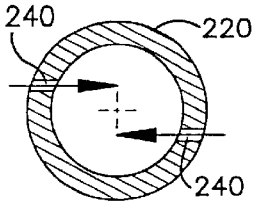
Figure 5F:
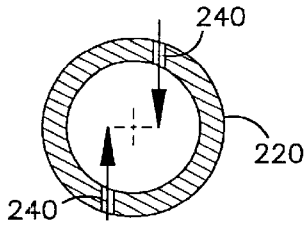
Figure 5G:
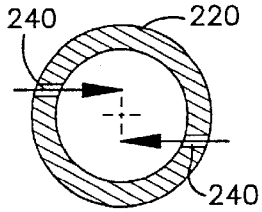
Figure 5H:
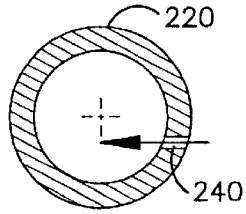

As shown in FIGS. 5A through 5H, if two or more groups of air jets are utilized, one group of air jets may be angularly rotated about the longitudinal axis relative to the first group of air jets in the clockwise or counterclockwise direction. It is preferred that the downstream group of air jets be angularly rotated in the range of about 0 to about 90 degrees relative to the first group in either the clockwise or counterclockwise direction. FIGS. 5A, 5C, 5E and 5G each illustrate a first or upstream group of air jets located within the insert 220 of FIG. 2. FIGS. 5B, 5D, 5F and 5H, represent a second or downstream group of air jets which are rotated 0, 45, 90 and 0 degrees in the counter-clockwise direction with respect to the corresponding first set of air jets of FIGS. 5A, 5C, 5E and 5G, respectively. FIG. 5H also illustrates that the second group of air jets need only comprise one air jet.

The total air flow to the four air jet orifices 240 in FIG. 2 may range from about 0.3 cubic feet per minute (CFM) to about 6.5 cubic feet/minute. If two pairs of air jets are utilized, the total air flow rate to the air jets is preferably 4.2 CFM. The air jet orifices 240 typically have an air velocity in the range of about 100 to about 1,000 feet/second, and more preferably in the range of about 400 to about 800 feet/second, and most preferably about 655 feet/second. These variables can be scaled appropriately for different diameter tubes.

The internal charging gun 200 is further provided with one or more electrodes 260 or other means known to those skilled in the art which function to discharge the tribocharging surfaces 222, 234 due to the build up of charge as a result of frictional contact with the powder. For example, the electrode may be a conductive pin, a pressed solid metal ring, an air washed porous ring, or a metal strip located along the longitudinal axis inside the charging tube. The one or more electrodes are preferably electrically grounded. However, the electrode 260 may also be charged to either a positive or negative electrical potential as shown in FIG. 2, preferably in the range of about 0 to about 10 kilovolts (kv). The electrode 260 may be positioned within the interior of the insert 220 or the nozzle 230, however it is preferred that the electrode be positioned upstream from the air jets. The one or more electrodes 260 may be airwashed, i.e., an air flow is provided from chamber 250 through passages 262 and 264 to blow powder off of the electrode 260.

A flat spray nozzle 230 is shown in FIG. 2 in conjunction with the invention, although other prior art nozzles would also work for the invention. The nozzle 230 has a slot 232 which creates a generally flat spray pattern, and an interior passageway 234 which is in fluid communication with the interior passageway 222 of the insert 220. It is preferred that the nozzle 230 be removably or releasably connected to the gun body 210 by any conventional methods. Because the nozzle is a high powder contact area, for a negative tribo charging gun, it is also preferred that the nozzle 230 be entirely made of, or have an interior surface 234 coated with a tribo-charging material such as a polyamide, particularly nylon 6/6, a polyamide blend, fiber reinforced polyamide resin, acetal polymer, aminoplastic resin or mixtures thereof. For a positive tribo charging gun, it is also preferred that the nozzle 230 be entirely made of, or have an interior surface 234 coated with a tribo-charging material such as fluoropolymers particularly PTFE. Thus depending upon the type of tribocharging material selected, a negative or positive charge is transferred to the powder particles upon contact with the interior surface 234 of the nozzle 230. Thus the nozzle 230 works in conjunction with the insert 220 to tribocharge the powder particles to the desired polarity as they contact the inner surface of the gun 200.

Although not shown, the insert 220 and nozzle 230 may be formed as an integral one piece unit which is releasably connected to the body 210 (not shown). Alternatively, the insert 220 and nozzle 230 may be releasably connected together and then releasably connected to the body. Thus, a particular advantage of the short internal charging gun 200 of the invention is the simple configuration of the insert 220 and nozzle 230, which allows these components to be fabricated out of, or coated with any of the described tribocharging materials and easily interchanged with the gun body 210. An array of inserts 220 and nozzles 230, made of or coated with different tribocharging materials, can be provided for use with a single gun body. An appropriate insert and nozzle can then be selected according to the type of powder to be sprayed, and according to the type of polarity to be applied to the powder. Since powders charge differently from one another depending on their chemistry, a material-specific insert can be used for a particular powder chemistry. For example, epoxies tend to charge positively, so a PTFE insert would be ideal for this powder. Polyesters, on the other hand, tend to charge negatively, and would therefore be charged better using a nylon insert.

The following examples illustrate several gun configurations having varying placement of air jets, type and position of electrodes and use of tribocharging materials. However, the invention is not limited to these examples, as many other combinations and configurations are possible.

Example 12

In one example of the invention, a tribocharging gun 200 having an insert 220 was fabricated out of nylon 6/6 material. The insert had two pairs of aligned, opposed air jets, with each air jet angled in the insert sidewall at an angle Θ of 60 degrees, and having a velocity of about 655 feet/second and a total air flow rate of 4.2 cubic foot/minute. The centerline of the first pair of air jets is longitudinally spaced 0.625" apart from the centerline of the second pair of air jets. A grounded electrode was mounted flush with the internal surface of the powderflow passageway and was angularly offset from the air jets by 60 degrees. The gun was 5.75 inches long as measured from the powder inlet to the tip of a flat spray nozzle. The powder flow rate was 20 lbs/hr using Ferro 153W-108 polyester urethane powder. The transfer efficiency for this configuration was 78.0%.

Example 13

In another example of the invention using the same gun configuration as described in Example 12, the electrode was charged to −8 KV. The transfer efficiency was measured at 84%.

Example 14

In another example of the invention, a short barrel tribocharging gun was fabricated out of Delrin 100 AF material. The total combined length of the insert and nozzle was 3.375 inches. A 4 mm Delrin 100AF flat spray nozzle was used. As shown in FIG. 2, the insert inlet diameter was 0.375 inches for a length of 1.25 inches, and was followed by a 45 degree step opening the insert diameter to 0.5 inches for the remainder of the tube length of 2.125 inches. Two pairs of opposing air jets were used, with each air jet having a diameter of 0.07 inches, and having an angle Θ of 60 degrees. The downstream set of air jets was rotated about the longitudinal axis by 5 degrees relative to the first pair of air jets. All of the air jets were offset a perpendicular distance from the longitudinal axis by 0.035 inches. Each air jet had an airflow rate of about 1 standard cubic feet per minute and a velocity of 655 ft/sec. A single grounded sharp tipped electrode was located upstream from the air jets as shown in FIG. 2. The electrode was angularly rotated about the longitudinal axis by 60 degrees relative to the first set of air jets. The transfer efficiency for this configuration was 70% using Ferro 153W-121 at 20 lbs/hour.

In summary, the above described short barrel tribocharging gun provides a novel lightweight spray gun which is easily maneuverable into tight spaces due to the guns shorter length and smaller diameter. Conventional tribcharging guns are typically 14–36 inches in length, while the short tribocharging gun provides a gun of about 6 inches long. The gun lends itself as a manual gun or use as a low cost automatic gun. The straight flow powder path allows for easy cleaning, as well as a removable insert which can be easily replaced by an inexpensive insert for quick color changes. The novel materials which are used to make the gun are injection moldable, thus reducing the machining costs significantly. Thus the invention provides a short barrel tribocharging gun which can accommodate a powder flow rate of up to about 30 lbs/hour and a reasonable transfer efficiency.

The invention further provides a short barrel negative tribocharging gun which can be used alone or in conjunction with a negative corona gun as described in more detail below. While providing all of the above described advantages, the short barrel negative tribocharging gun further provides the advantage of excellently applying and charging polyester powders such as TGIC polyesters, epoxy/polyester hybrid powders, and polyester urethanes, as well as thermoplastic powders such as PVC and PTFE powders.

III. Unipolarity Corona Gun with Tribo-Charging Components.

Figure 6:
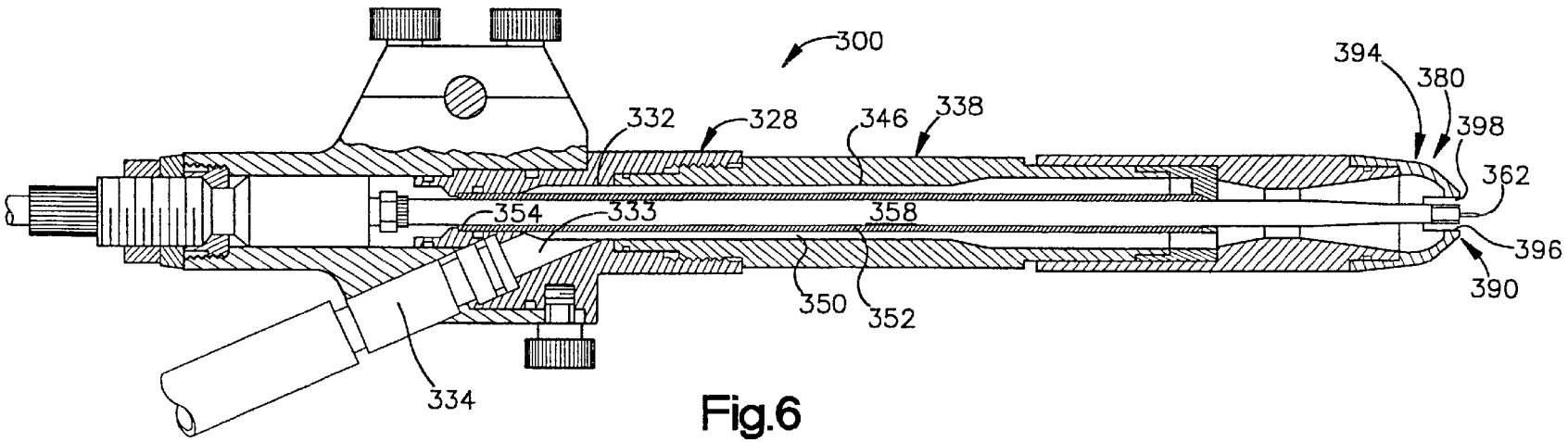
FIG. 6 illustrates a cross-sectional view of a corona gun which incorporates the novel unconventional materials of the invention.

Referring now to FIG. 6, a unipolarity corona spray gun 300 is provided for spraying fluidized powder that has been charged to either a positive or negative polarity. The term "unipolarity" refers to a powder spray gun or powder supply system wherein the components are selected to charge the powder coating material to a single polarity. An example would be a corona gun with a negative polarity power supply which includes tribocharging components such as the spray nozzle which also charges the powder negatively. The gun 300 comprises a rearward barrel 328 which may be secured to a mounting block. The rearward barrel 328 has an internal bore 332 and an angled bore 333 for connection to a powder supply tube 334. The powder supply tube 334 functions to introduce fluidized powder through the angled bore 333 into the throughbore 332 of the rearward barrel member 328. The forward end of the rearward barrel member 328 is connected to a forward barrel member 338, which further comprises a throughbore 346 which is axially aligned with bore 332 to form a powder flow passageway 350 for transferring powder from the powder supply tube 334 towards the forward end of the gun 300. A flat spray nozzle 394 is located on the forward end of the forward barrel member 380.

A barrel liner 352 extends axially within the powder passageway 350 which is mounted within the end of the rearward barrel member 328. The barrel liner 352 receives and supports a high voltage electrostatic cable assembly 358. An electrode 362 is mounted at the forward end of the cable assembly 352 and extends through a bore 396 of the of the nozzle tip 390 and extends forward of the spray nozzle 394 between the rectangular slot 398. The electrode 362 extending forward of the spray nozzle 380, produces a strong electrostatic field between it and the object to be coated. The electrode may be charged positively or negatively depending upon the desired gun polarity. It is preferred that the electrode be charged to the desired polarity in the range of about 60 to about 100 kv.

The powder contact surfaces of the corona gun 300 are the barrel liner 352, the powder passageway 350, the powder supply tube 334, and the passageway 372 through nozzle 380. For a positive polarity corona gun which charges the powder to a positive polarity, one or more powder contact surfaces 334, 350, 352, or 372, for example, are comprised of materials which tribocharge the powder positively. These materials are selected from the group consisting of: polyethylene, a fluoropolymer or mixtures thereof. It is preferred that the fluoropolymer comprise polytetrafluoroethylene. For a negative polarity corona gun which charges the powder to a negative polarity, one or more of the powder contact surfaces 334, 350, 352, or 372, for example, of the corona gun 300 are selected to be of a material which tribocharges the powder negatively. These surfaces are comprised of a material selected form the group consisting of: a polyamide, a polyamide blend, a fiber reinforced polyamide resin, an acetal polymer, an aminoplastic resin or mixtures thereof, as described in detail in Section I.

Thus the unipolarity corona gun of the present invention utilizes tribocharging to charge the powder as well as the corona charging. The tribocharging which occurs is of the same polarity as and therefore increases the charge on the powder which results from the corona charging electrode. Because the powder contact surfaces add to the charge on the powder produced by the corona electrode, less electrode voltage is needed to produce the same amount of charge as in prior art guns. Thus for a negative polarity gun, reduced back ionization occurs because the voltage is lower. This results in an improved surface finish. This reduction in electrode voltage also reduces the Faraday Cage effect. In addition, a smaller power supply can be used to produce the same voltage.

Figure 7:
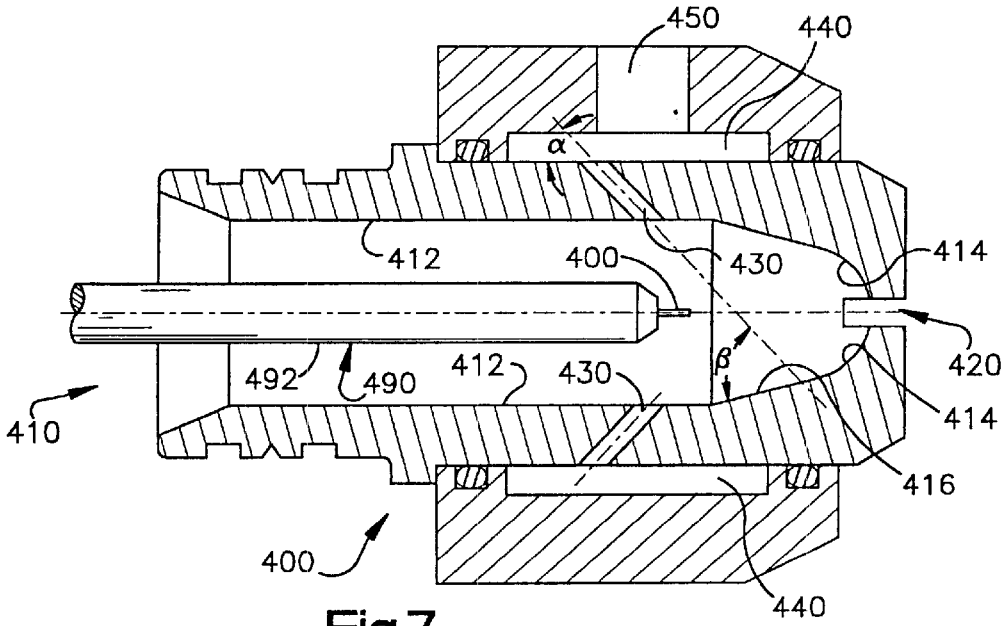
FIG. 7 illustrates a cross-sectional view of a flat spray nozzle which incorporates the novel unconventional materials and one or more airjets of the invention.

In an alternate embodiment of the invention, the corona gun 300 may additionally include an enhanced tribocharging nozzle 400 as shown in FIG. 7. Tribocharging nozzle 400 may be used with other prior art corona or tribocharging guns and is not limited to the corona gun 300 as described above. Tribocharging nozzle 400 provides a large interior surface area which may be utilized in order to tribocharge the powder. The powder may be charged positively or negatively as desired depending upon the triboelectric material selected, as described in more detail, below.

The nozzle shown generally at 400 has a powder inlet end 410 and an interior flow passageway 412 which is in fluid communication with the interior passageway of a prior art corona gun or triboelectric gun (not shown). The inlet end 410 may be threaded or otherwise configured to be releasably connected to the body of a prior art spray gun. The interior passageway 412 is preferably cylindrically shaped with a transition surface 414 leading to the nozzle slot 420. The nozzle 400 has a slot 420 shaped to create a generally flat spray pattern. The depth and width of the nozzle slot 420 may be sized as needed for the particular application.

Because the nozzle surfaces 412, 414 are in contact with the powder, it is preferred that the nozzle 400 be entirely made of, or have an interior surface coated with a tribocharging material. For a positive polarity corona gun, it is preferred that the nozzle be made or have interior powder contact surfaces coated with a material selected from the group consisting of: fluoropolymers particularly PTFE. For use with a negative polarity gun, it is more preferable that the nozzle 400 be entirely made of, or have interior surfaces 412, 414 coated with the materials selected from the group consisting of: a polyamide, particularly nylon 6/6, a polyamide blend, a fiber reinforced polyamide resin, an acetal polymer, an aminoplastic resin, or mixtures thereof. Thus depending upon the type of tribocharging material selected, a negative or positive charge is transferred to the powder particles upon contact with the interior surfaces 412, 414 of the nozzle 400. Thus the nozzle 400 can work in conjunction with the corona charging electrode of the prior art spray guns in order to charge the powder with the same polarity as the corona electrode.

The nozzle 400 may preferably include one or more air jet orifices 430 which are positioned for fluid communication with the internal passageway 412 of the nozzle. Air or other fluid is provided to the air jet orifices 430 for example by chamber 440 which is connected to an external fluid source (not shown) via port 450. It is preferred that the air jet orifices 430 be sized and configured to provide an air velocity in the range of about 100 to about 1,000 feet/second, and more preferably in the range of about 400 to about 800 feet/second. It is additionally preferred that the air jet orifice(s) 430 comprise an angle $\alpha$ with respect to the longitudinal axis of the insert internal passageway in the range of about 0 to about 90 degrees, and more preferably in the range of about 45 to about 90 degrees. It is preferred that the angle of the air jet orifices 430 be such that the air jets intersect to provide turbulence resulting in increased frictional contact with the charging surface. It is preferred that the impact angle $\beta$ of the air jets upon the transition surface 414 should be in the range of about 45 to about 90 degrees, and more preferably about 60 degrees.

The nozzle 400 may additionally comprise one or more electrodes 460 or other means known to those skilled in the art to discharge the interior surface 412 from charge build-up. The one or more electrodes is preferably grounded. Alternatively, the one or more electrodes may have a positive or negative charge in the range of about 0 to about 100 KV, and more preferably in the range of about 0 to about 10 kv. The high voltage electrode(s) is charged positively if an electronegative charging material is utilized, and the electrodes are charged negatively if an electropositive charging material is utilized on the interior surface of the nozzle. As shown in FIG. 7, the electrode may be positioned within an electrode holder 490. The electrode holder 490 has an outer surface 492 made of the materials described for the internal passageway 412 of the nozzle described above. However, it is important to note that other electrode configurations are possible such as for example, a ground ring, or a blunt or sharp tipped conductive pin. If a conductive pin is used, it may be positioned at a right angle to the fluid passageway anywhere in the nozzle 400. The electrodes are positioned upstream within about 2 inches of the air jet impingement on the wall.

In a preferred embodiment of the nozzle, the electrode is grounded and positioned upstream of 2 pairs of aligned, opposed air jets which are laterally spaced one diameter apart. The air jets are angled at 60 degrees with respect to the longitudinal axis.

IV. Tribo-Charging Components of Powder Delivery Systems

The invention further provides tribocharging powder contact surfaces in various components throughout a powder delivery system which can be used to tribocharge the powder to the same polarity as the corona powder supply. Tribocharging at several areas along the delivery system incrementally increases the charge on the powder as it passes through each tribocharging area. This benefits corona gun systems with increased transfer efficiency. This idea can also be used with tribocharging gun systems. The tribocharging areas of the powder supply system tribocharge the powder to the same polarity as is used in the triboguns of the system.

Figure 9:
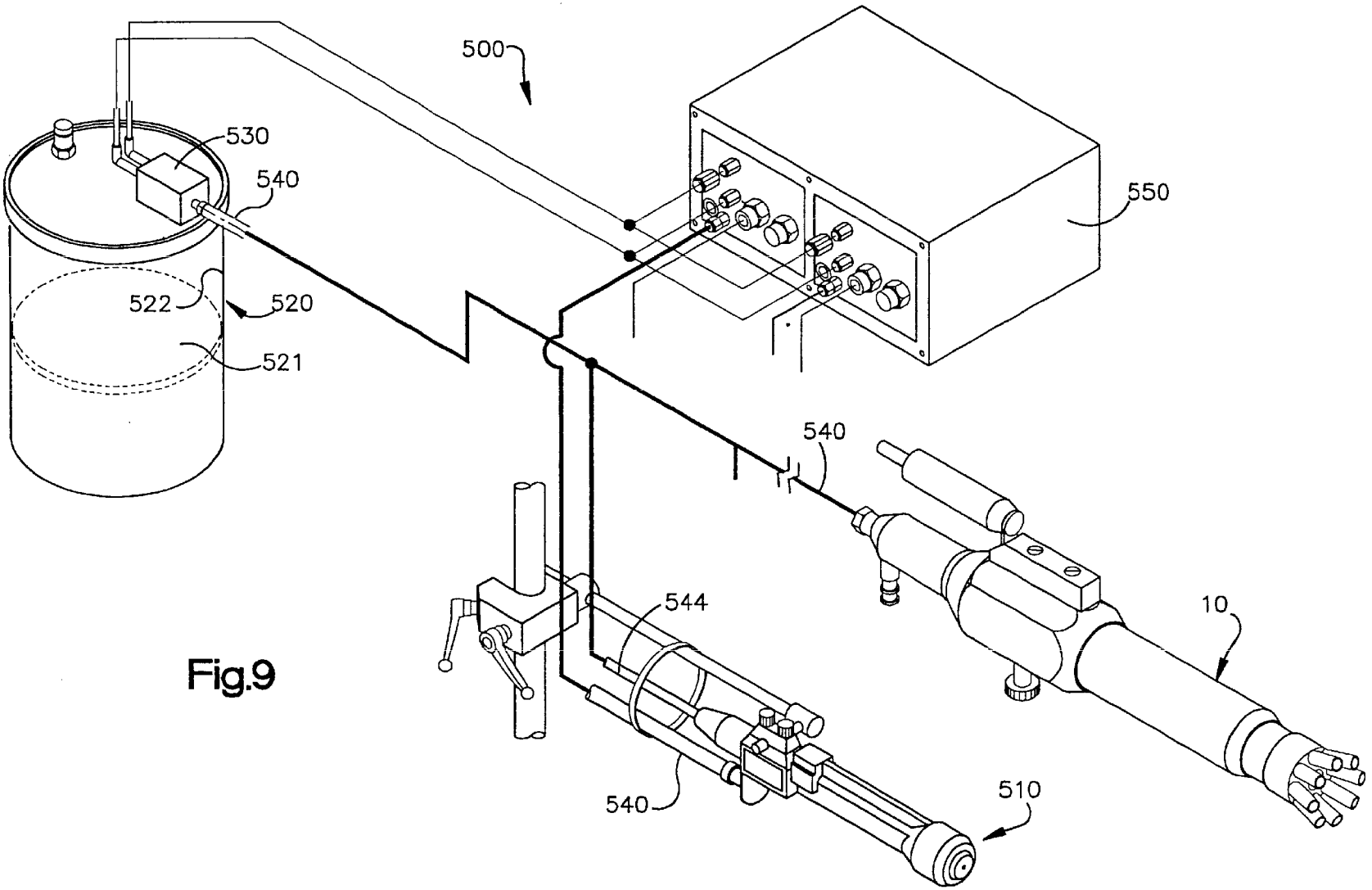
FIG. 9 illustrates a perspective schematic view of powder coating system which includes a corona and tribocharging gun which charge the powder to the same polarity.

As shown in FIG. 9, a typical powder spray system 500 includes a spray gun 510 connected by a powder supply hose 540 to a hopper 520, through a powder pump 530 mounted on top of the hopper. The spray gun 510 is, for example a negative charging corona type powder spray gun, but may alternatively be a positive charging corona gun, or a negative or positive tribo-charging powder spray gun.

An electrical line 544 is connected to the gun 510 from control system 550 which regulates air pressure to pump 530 and the voltage of the corona electrode in gun 510. Within the powder hopper 520, a diffuser plate 521 is configured to extend over a cross-sectional area within the hopper, and is formed of a porous material through which air passes to fluidize the powder. Because the hopper sidewalls 522 and the diffuser plate 521 are high contact areas of the powder, the invention includes constructing the plate 521 and sidewalls 522 out of the negative tribo pre-charging materials selected from the group consisting of polyamides, particularly nylon 6/6, a polyamide blend, fiber reinforced polyamide resin, acetal polymer, aminoplastic resin or mixtures thereof. Thus contact of the powder with the diffuser plate 521 and sidewalls within the hopper 520 pre-charges the powder negatively before it is transported to negative corona gun 510.

Figure 8:
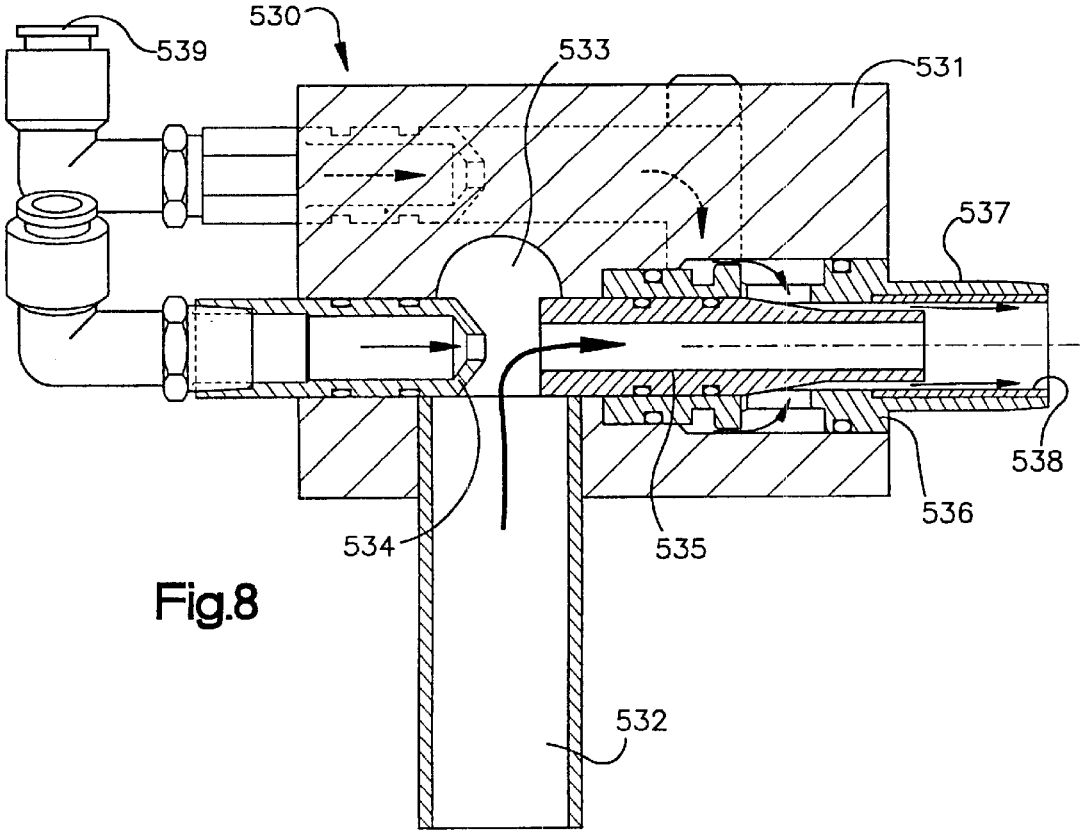
FIG. 8 is a cross-sectional view of a powder pump of a powder coating system which incorporates the novel unconventional materials of the invention.

The pump 530, shown in cross-section in FIG. 8, includes a body 531 with a powder inlet tube 532 leading to a cavity 533 which is intersected by an ejector or venturi nozzle 534 and a venturi throat 535. The venturi throat 535 is held in the pump body 531 by a throat holder 536 which extends out of the pump body to provide an attachment fitting 537 for a hose. Within the attachment fitting 537 is a wear sleeve 538, also referred to as a wear tube, downstream of the pump throat. The wear sleeve prevents impact fusion on the inside wall of the throat holder. An atomizing air inlet 539 intersects with the throat holder 536 to provide air flow which joins the powder air mixture from the venturi throat.

This area in the powder delivery system is thus a suitable site for use of one of the described pre-charging materials. Thus it is desired that the venturi throat 535, wear sleeve 538, pump suction tube 532, and powder hose (not shown) be coated with or fabricated from the materials selected from the group consisting of a polyamide, polyamide blend, fiber reinforced polyamide resin, acetal polymer, aminoplastic resin or mixtures thereof, as described in more detail above, to precharge the powder triboelectrically with a negative polarity. It is additionally preferred that the length of the venturi throat 535 and the throat holder 536 be extended by, for example, from one to five inches beyond the edge of the pump body. Optimally, this extended length provides for substantial additional negative tribocharging of powder at this region of the powder delivery system.

Powder pre-charged in the powder delivery system in the hopper and/or pump as described in this section flows through the hose to arrive at the gun with a pre-established negative charge. This pre-charging augments the additional negative charge applied at the gun by the corona electrode.

V. Unipolarity Powder Coating System Including Corona and Tribocharging Guns

As shown in FIG. 9, a corona gun 510 is shown together in use with a tribocharging powder spray gun 10 of the invention, which has been described in detail, above. The corona gun 510 and the tribocharging gun 10 have the same polarity. This unique combination allows for the tribocharging gun 10 to be used as a touch up gun, for example, to penetrate the corners or hard to reach parts that the corona gun 510 has not effectively coated. This exemplary combination of a negative corona gun 510 and a negative tribocharging gun 10 is preferably connected to a common powder delivery system 520, which pre-charges the powder negatively as described above. Alternatively, the tribocharging gun may comprise the short barrel gun 200 (not shown) which is described in more detail, above. This novel combination of one or more negative corona guns with one or more negative tribo guns, optimally with a negative pre-charging powder delivery system, used to coat different parts of the same workpiece is one important embodiment of this invention.

VI. Tribocharging Gun with Air Jets

Figure 10:
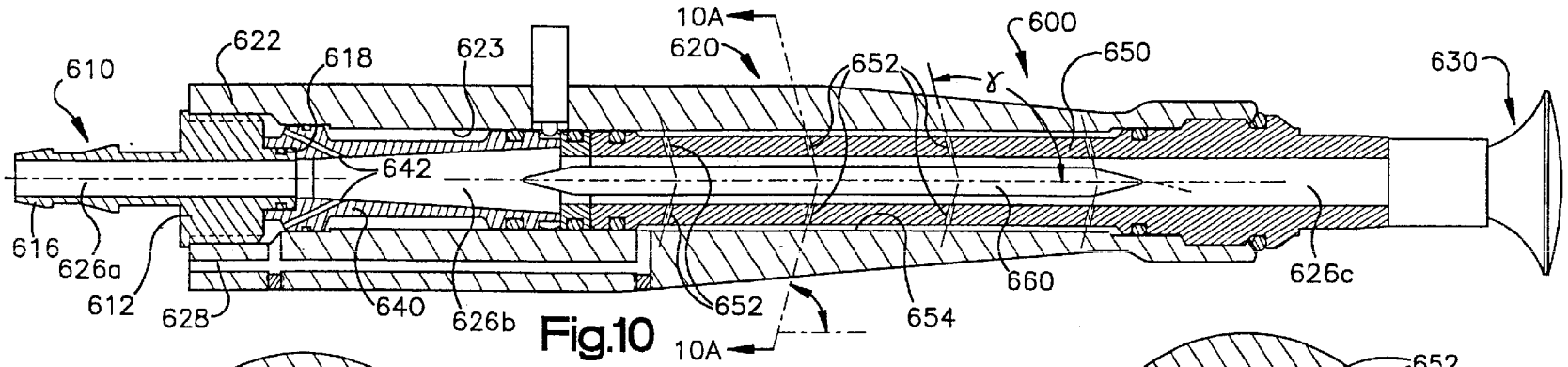
FIG. 10 is a cross-sectional view of an alternate embodiment of a tribocharging gun of the present invention which incorporates airjets.
Figure 10A:
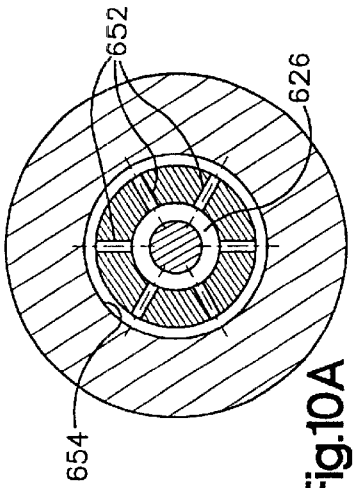
FIG. 10A is a cutaway view of the gun shown in FIG. 10 in the direction 10A—10A.

As shown in FIG. 10, a novel tribocharging gun 600 is provided which comprises a powder feed section 610, a powder charging section 620, and a spray nozzle 630 located at the outlet of the gun. The powder charging section 620 of the tribocharging gun 600 further comprises a cylindrically shaped body 622 having an internal bore 623 for housing the internal components of the gun. Housed within the bore 623 of the body 622 is a powder tube connector 612 having an internal bore 626*a*. A first end 616 of the connector 612 is connected to a powder supply tube (not shown) for supplying fluidized powder to the powder flow passageway 626*a, b,c* of the gun 600. The second end 618 of the powder tube connector 612 is connected to an inlet air entry 640. The inlet air entry 640 has an internal passageway 626*b* and one or more angled holes or air jets 642 which are connected to an air manifold 628 located in the body 622 for supplying pressurized air to the air jets 642 in order to increase the velocity and induce turbulence of the fluidized powder entering the gun. Connected to the inlet air entry 640 is an outer wear tube 650 which has an internal passageway which is part of the powder flow passageway 626 of the gun. The outer wear tube 650 further comprises one or more air jets 652. Pressurized air is provided to the air jets 652 via passageway 654 which is in fluid communication with air manifold 628. The gun 600 may further be provided with an optional inner wear surface 660 which forms an annular powder flow path. As shown in a cross sectional view in FIG. 10A, a plurality of air jets 652 are arranged in an opposed configuration at one or more longitudinal stations. Preferably the air jets 652 comprise an angle $\gamma$ (as measured counterclockwise from the longitudinal axis) preferably in the range of about 90 to about 135 degrees. The air jet velocity is preferably high enough to induce turbulence and cause the powder flowing through passageway to contact the wall opposite the air jet, in order to increase the tribocharging of the powder. It is preferred that the air jet velocity be in the range of about 100 to about 1,000 feet/second and more preferably in the range of about 400 to about 800 feet/second.

In order to provide tribocharging of the powder, the powder contact surfaces of the gun such as the internal surface of the powder flow passageway 626*a–c*, the nozzle 630 and the outer surface of the inner charge tube 660 are constructed from or coated with a tribocharging material. For a positive polarity tribocharging gun the powder contact surfaces are preferably selected from the group consisting of: fluoropolymers particularly PTFE. For a negative polarity tribocharging gun the powder contact surfaces are preferably selected from the group consisting of: nylon, particularly nylon 6/6, a polyamide blend, a fiber reinforced polyamide resin, an acetal polymer, an aminoplastic resin or mixtures thereof.

Figure 11A:
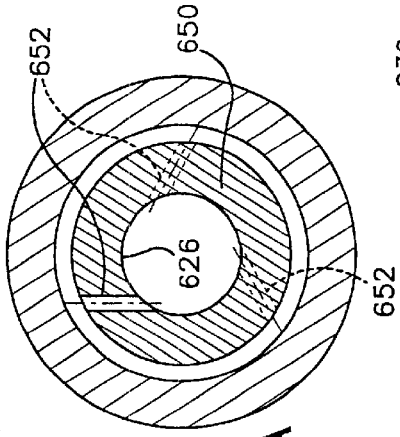
FIG. 11A is a cutaway view of the gun shown in FIG. 11 in the direction 11A—11A.
Figure 11:
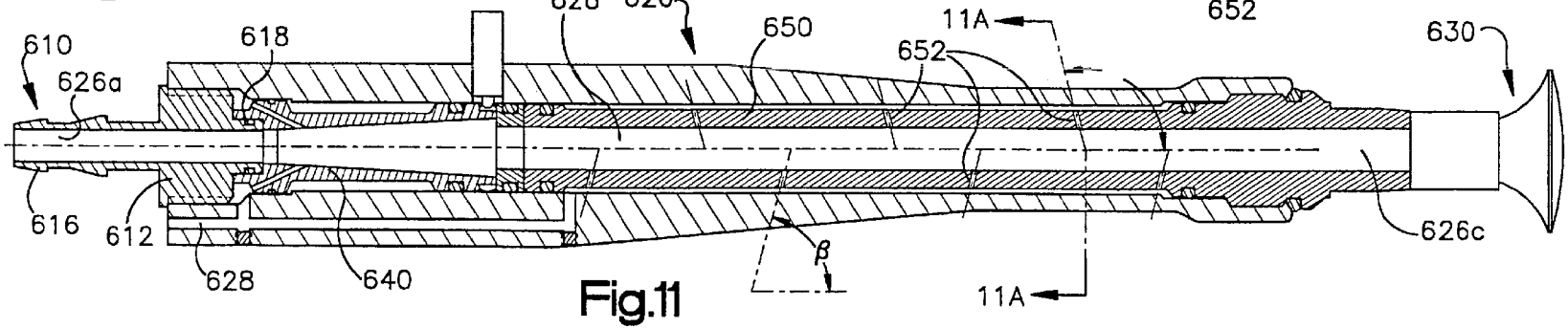
FIG. 11 is a cross-sectional view of yet another alternate embodiment of a tribocharging gun of the present invention which incorporates airjets arranged in a helical pattern.

In yet another embodiment of the invention as shown in FIG. 11, the tribocharging gun is the same as described above, except for the following differences. First, no inner charge tube 660 is utilized. Second, the air jets 652 of the tribocharging gun 600 located within the outer wear tube 650 are arranged in a helical pattern about the longitudinal axis as shown in FIGS. 11 and 11A. Optionally, the air jets 652*a* located on the upper portion of the tube 650 can have a different angular orientation than the air jets 652*b* located on the lower portion of the tube 650 (not shown). The air jets 652*a*, 652*b* when configured in this manner, are designed to impact the fluidized powder against the opposite wall in a staggered or wave fashion in order to increase the tribocharging of the powder. It is preferred that there be 3–4 sets of holes arranged in the configuration, with each set comprising 2 or more holes. This helical configuration functions to induce turbulence and swirl the fluidized powder in a helical fashion so that the relatively heavier powder is spun or induced to impact the wall via centrifugal forces into contact with the passageway wall.

One advantage of this embodiment is that to cause each powder particle to impact the charging surface numerous times and thereby increase the charge on the powder, instead of forming mechanical waves on the charging surface such as shown in the FIG. 1 gun, the charging surface is a straight cylinder which is easy to manufacture, while the air jets 652 cause the powder particles to take a turbulent route through the flow passage 626*a,b,c*, impacting the surface many times to increase the triboelectrically induced charge on the powders.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that invention not be limited to the particular embodiment disclosed as the best mode contemplated for carrying out this invention, but that the invention will include all embodiments falling within the scope of the appended claims.

Having thus described the invention, we claim:

1. A system for applying powder coating materials to articles, said system including at least one corona charging spraying apparatus and at least one tribocharging spraying apparatus, said corona charging spraying apparatus having an electrode for charging said powder coating material a first charging polarity, said tribocharging spraying apparatus having a powder flow path, wherein said powder flow path has a charging surface for triboelectrically charging powder coating material which comes in contact with said charging surface, said powder coating material being charged to said first polarity by said charging surface of said tribocharging spraying apparatus.

2. The system of claim 1, wherein said first charging polarity is a negative electrical polarity.

3. The system of claim 2, wherein said charging surface comprises a negative tribocharging material selected from the group consisting of: a polyamide, a polyamide resin blend, a fiber reinforced polyamide, an aminoplastic resin, an acetal polymer, or mixtures thereof.

4. The system of claim 3, wherein said acetal polymer comprises polytetrafluorethylene.

5. The system of claim 4, wherein said polytetrafluorethylene is present in the amount of 20% by weight of said acetal polymer.

6. The system of claim 1 wherein said corona charging spraying apparatus is used to coat a first part of said article and said tribocharging spraying apparatus is used to coat a second part of said article.

7. The system of claim 6 wherein said the second part of said article is a recessed part of said article.

8. The system of claim 1, wherein said charging surface comprises a material comprising a mixture of an acetal polymer and polytetrafluorethylene.

9. The system of claim 8, wherein said polytetrafluorethylene is present in the amount of 20% by weight of said acetal polymer.

10. The system of claim 1, wherein said charging surface comprises a polyamide material.

11. The system of claim 1, wherein said charging surface comprises a polyamide resin blend material.

12. The system of claim 1, wherein said charging surface comprises a fiber reinforced polyamide material.

13. The system of claim 1, wherein said charging surface comprises an aminoplastic resin material.

14. The system of claim 1, wherein said charging surface comprises an acetal polymer material.

* * * * *

UNITED STATES PATENT AND TRADEMARK OFFICE

CERTIFICATE OF CORRECTION

PATENT NO. : 6,645,300 B2
DATED : November 11, 2003
INVENTOR(S) : William R. Rehman et al.

It is certified that error appears in the above-identified patent and that said Letters Patent is hereby corrected as shown below:

Column 5,
Lines 23, 27 and 34, please delete "polytetrafluoethylene" and insert -- polytetrafluoroethylene --.

Column 10,
Line 2, please delete "know" and insert -- known --.

Signed and Sealed this

Third Day of February, 2004

JON W. DUDAS
*Acting Director of the United States Patent and Trademark Office*